US006880308B2

(12) United States Patent
Seiz et al.

(10) Patent No.: US 6,880,308 B2
(45) Date of Patent: Apr. 19, 2005

(54) LATTICE GIRDER SUPPORTING FRAME HAVING STRAIGHT BRACE PARTS

(75) Inventors: Rudolf Seiz, Herrsching (DE); Rudi Podjadtke, Herne (DE)

(73) Assignee: Bochumer Eisenhutte Heintzmann GmbH & Co. KG, Bochum (DE)

( * ) Notice: Subject to any disclaimer, the term of this patent is extended or adjusted under 35 U.S.C. 154(b) by 189 days.

(21) Appl. No.: 09/841,094

(22) Filed: Apr. 25, 2001

(65) Prior Publication Data

US 2002/0000074 A1 Jan. 3, 2002

(30) Foreign Application Priority Data

Apr. 27, 2000 (DE) ..... 100 20 572

(51) Int. Cl.[7] ..... E04C 3/32

(52) U.S. Cl. ..... 52/694; 52/664; 52/730.1; 52/737.1

(58) Field of Search ..... 52/693, 69 J, 692, 52/690

(56) References Cited

U.S. PATENT DOCUMENTS 4,386,489 A * 6/1983 Sheahan ..... 52/694
4,748,786 A * 6/1988 Hannah ..... 52/694
5,054,964 A * 10/1991 Salzmann et al. ..... 405/288
5,235,791 A * 8/1993 Yaguchi ..... 52/649.1
5,448,866 A * 9/1995 Saito et al. ..... 52/414

FOREIGN PATENT DOCUMENTS

| | | | |
|---|---|---|---|
| DE | 3040638 | * | 5/1982 |
| DE | 3625810 | * | 2/1988 |
| DE | 4003525 | * | 8/1990 |
| DE | 19711627 | * | 8/1997 |
| GB | 2195677 | * | 4/1988 |
| WO | WO89/00226 | * | 1/1989 |

* cited by examiner

*Primary Examiner*—Carl D. Friedman
*Assistant Examiner*—Yvonne M. Horton
(74) *Attorney, Agent, or Firm*—Sughrue Mion, PLLC

(57) ABSTRACT

A lattice girder supporting frame for tunnel lining includes upper and lower boom members arranged parallel to each other to form a triangle. Truss braces spatially connect the upper and lower boom members to each other, wherein each of the truss braces has straight brace parts angled relative to each other, and each of the straight brace parts is connected to each other at one end via a straight bridge piece. The truss braces are arranged in a symmetrical plane extending laterally from the upper boom member to an axis of the lower boom members. Cross ties extend at right angles relative to the lower boom members, for connecting the lower boom members to each other, wherein the truss braces abut the lower boom members without bending and are welded to the lower boom members.

8 Claims, 4 Drawing Sheets

LATTICE GIRDER SUPPORTING FRAME HAVING STRAIGHT BRACE PARTS

TECHNICAL FIELD

The present invention is directed to a lattice girder supporting frame. In particular, the present invention is directed to a lattice girder supporting frame for tunnel lining, having a plurality of boom members and truss braces welded together to provide a high-load bearing capacity.

This application is based on German Patent Application 100 20 572.0, which is incorporated herein by reference.

BACKGROUND

Conventional lattice girders are described, for example, in DE 197 11 627 C 2. The lattice girder has three parallel boom members which are connected to each other by V-shaped truss braces. The truss braces are bent at the portion where the truss brace and boom member are connected. The truss braces and boom members are welded together at these portions. A cross-tie is provided to hinder a zip-like failure of this weld.

EP 0073 733 A 1 describes a lattice girder having three parallel boom members which are spatially secured relative to each other by means of internal one-piece bracing elements. These bracing elements have very narrow bending radii which can be used for comparatively thin elements only.

SUMMARY OF THE INVENTION

The invention is based on the objective of developing a lattice girder supporting frame and bracing elements for lattice girder supporting frames of the generic types, which—while improving such properties as high stressability of welds, shortening of the unsupported lengths of braces, avoiding of buckling of braces—allow to make production substantially more cost-effective due to the possibility of compensating manufacturing tolerances.

The present invention has a structure in which the bracing of the lattice girder is arranged so that a higher load bearing capacity is achieved by avoiding bending in the area of the lower booms.

The objectives of the present invention are achieved by a lattice girder supporting frame for tunnel lining which includes upper and lower boom members arranged in parallel relative to each other and forming a triangle, truss braces spatially connecting the upper and lower boom members to each other, wherein each of the truss braces has straight brace parts spaced in a V-shape relative to each other, and each of the straight brace parts are connected to each other at one end via a straight bridge piece, wherein the truss braces are arranged in a symmetrical plane extending laterally from the upper boom member to an axis of the lower boom members. Cross ties extend at right angles relative to the lower boom members, for connecting the lower boom members to each other and the truss braces abut the lower boom members without bending and are welded to the lower boom members.

A bracing element of the present invention includes two brace parts angled relative to each other, wherein one end of each of the brace parts has a curved part and the other end of each of the brace parts is straight The other end of each of the brace parts is adapted to be connected to the lower boom members without bending. A straight brace part connects the brace parts to each other at the curved parts so as to form a truss brace, wherein the straight brace part extends parallel to the upper and lower boom members. Two truss braces are connected to each other via cross-ties so as to form the bracing element, wherein the cross-ties are fixedly secured by a weld to the truss braces, and wherein the cross-ties are adaptable to contact the lower boom members.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE INVENTION

Embodiments of the present invention are now described with reference to FIGS. 1*a*–4*b*.

Figure 1A:
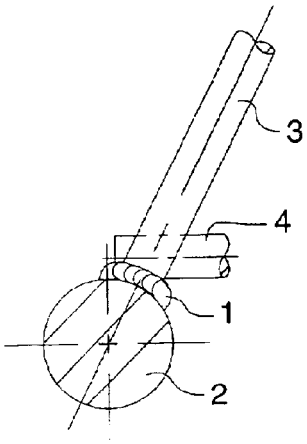
FIG. 1*a* illustrates a cross-sectional view along line I—I of FIG. 1*a;*
Figure 1B:
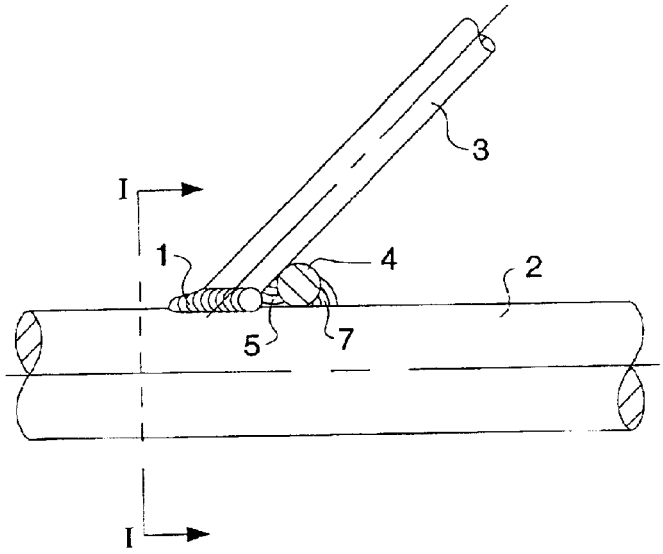
FIG. 1*b* illustrates a lateral view of a first embodiment of the lower boom member arrangement.

As shown in FIGS. 1*a* and 1*b*, lower boom members 2, straight brace parts 3 and cross-ties 4 are provided for a lattice girder structure. A welded connection 1 between lower boom member 2 and straight brace part 3, a welded connection 5 between straight brace part 3 and cross-tie 4, and a welded connection 7 between boom member 2 and cross-tie 4, are provided to attach the members together.

The cross-ties 4 are positioned welded to both the straight brace part 3 and the lower boom member 2 wherein the straight brace part abuts the lower boom member 2 at an acute angle (as viewed in FIG. 1*b*), and the cross-ties 4 are provided inside the acute angle so as to be welded to the lower boom member 2 and the straight brace parts 3.

Figure 2A:
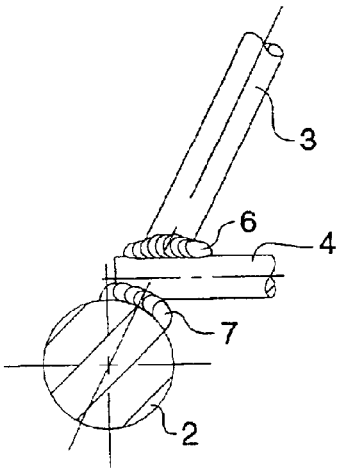
FIG. 2*a* illustrates a cross-sectional view along line II—II of FIG. 2*b;*
Figure 2B:
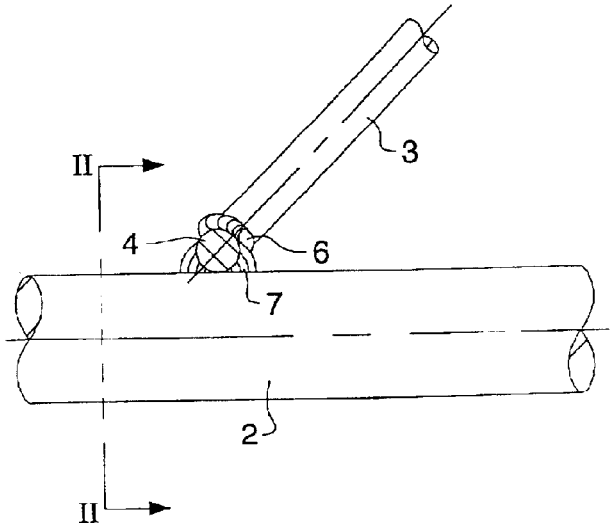
FIG. 2*b* illustrates a lateral view of an alternative embodiment of the lower boom member

FIGS. 2*a* and 2*b* show another embodiment having a welded connection 6, 7 between straight brace part 3, cross-tie 4, and boom member 2. In this embodiment, the cross tie 4 is disposed between the straight brace part 3 and the lower boom member 2.

Figure 3B:
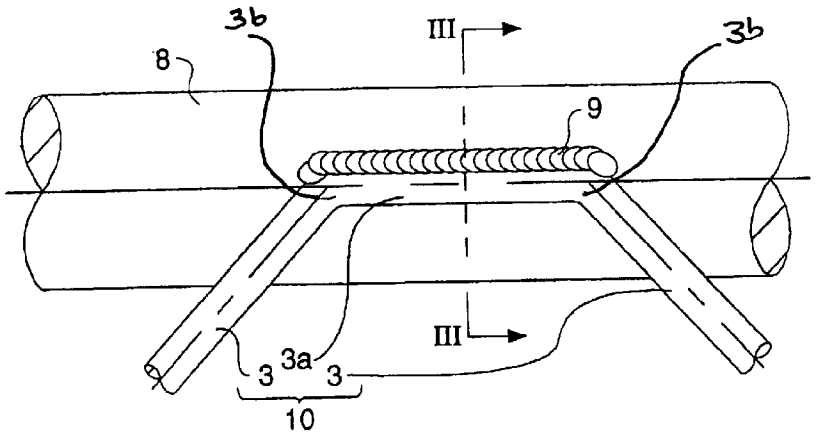
FIG. 3*b* illustrates a lateral view of the upper boom arrangement.

As shown in FIG. 3*b*, two straight brace parts 3 connected by a straight bridge piece 3*a* form a truss brace 10. The end of the straight brace part 3 has a curved (or buckled) portion 3*b* which connects to the straight bridge piece 3*a* (see FIGS. 4*a*and 5), while the other end of the straight brace part 3 is a straight portion 3*c*.

Figure 3A:
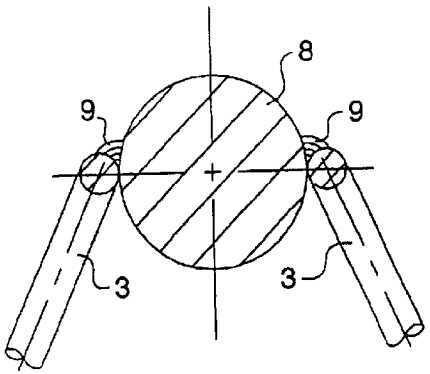
FIG. 3*a* illustrates a cross-sectional view along line III—III of FIG. 3*b;*
Figure 3C:
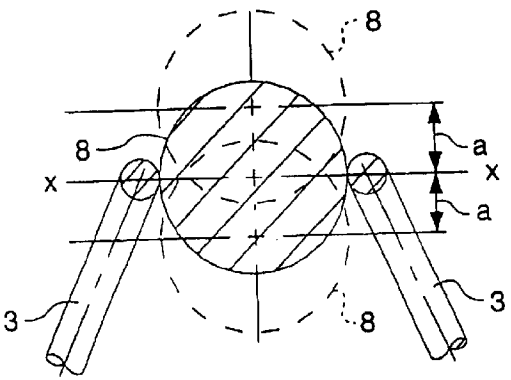
FIG. 3*c* illustrates alternative arrangements of FIG. 3*a;*

FIGS. 3*a* and 3*b* show the lateral positioning of the truss brace 10 relative to an upper boom member 8. In this embodiment, the upper boom member 8 is relatively thicker than the lower boom members 2. While FIGS. 3*a* and 3*b* show that the straight brace parts 3 are provided on opposite sides of the boom member 8, FIG. 3*c* shows that the upper boom member 8 may be variably positioned with respect to the truss braces 10 by a distance "a". In FIG. 3*c*, "X" represents a plane passing perpendicularly through the center of the straight bridge piece 3*a*. Thus, the upper boom member 8 may be variably positioned at X or at X−a or X+a, where a is less than or equal to the radius of the upper boom member 8.

Figure 4B:
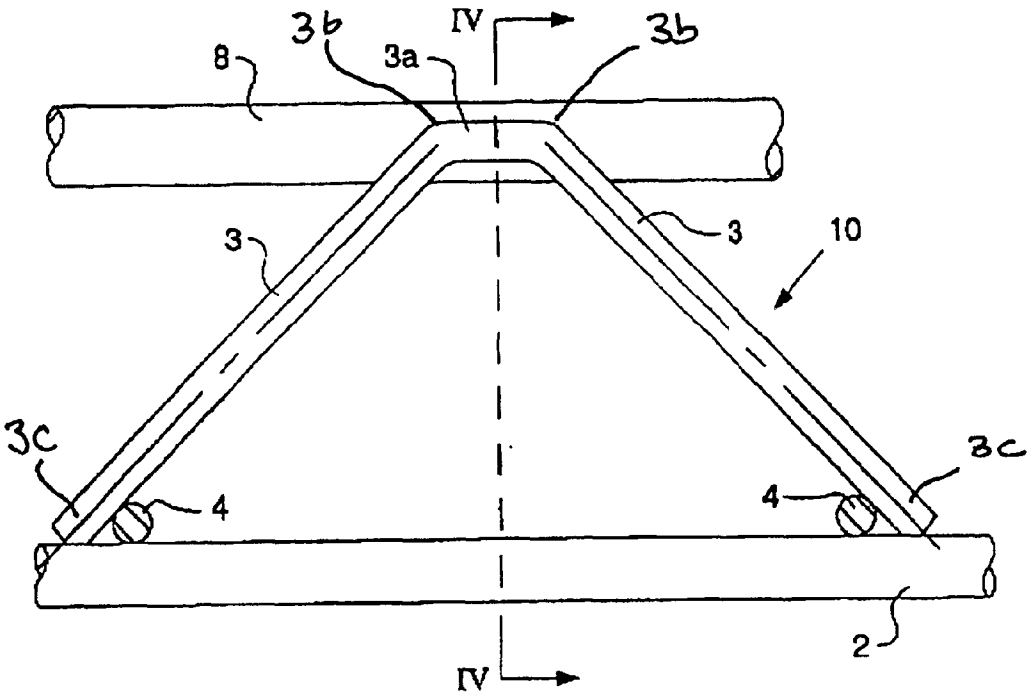
FIG. 4*b* illustrates another view of the present invention.
Figure 4A:
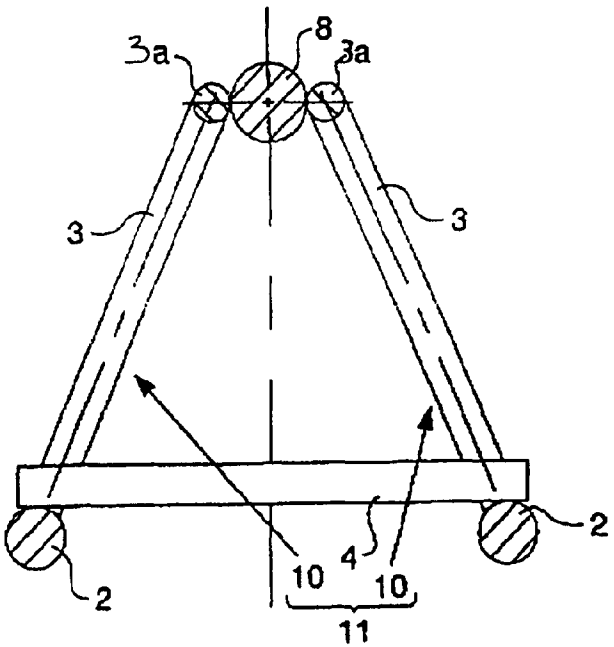
FIG. 4*a* illustrates a cross-sectional view along line IV—IV of FIG. 4*b;*
Figure 5:
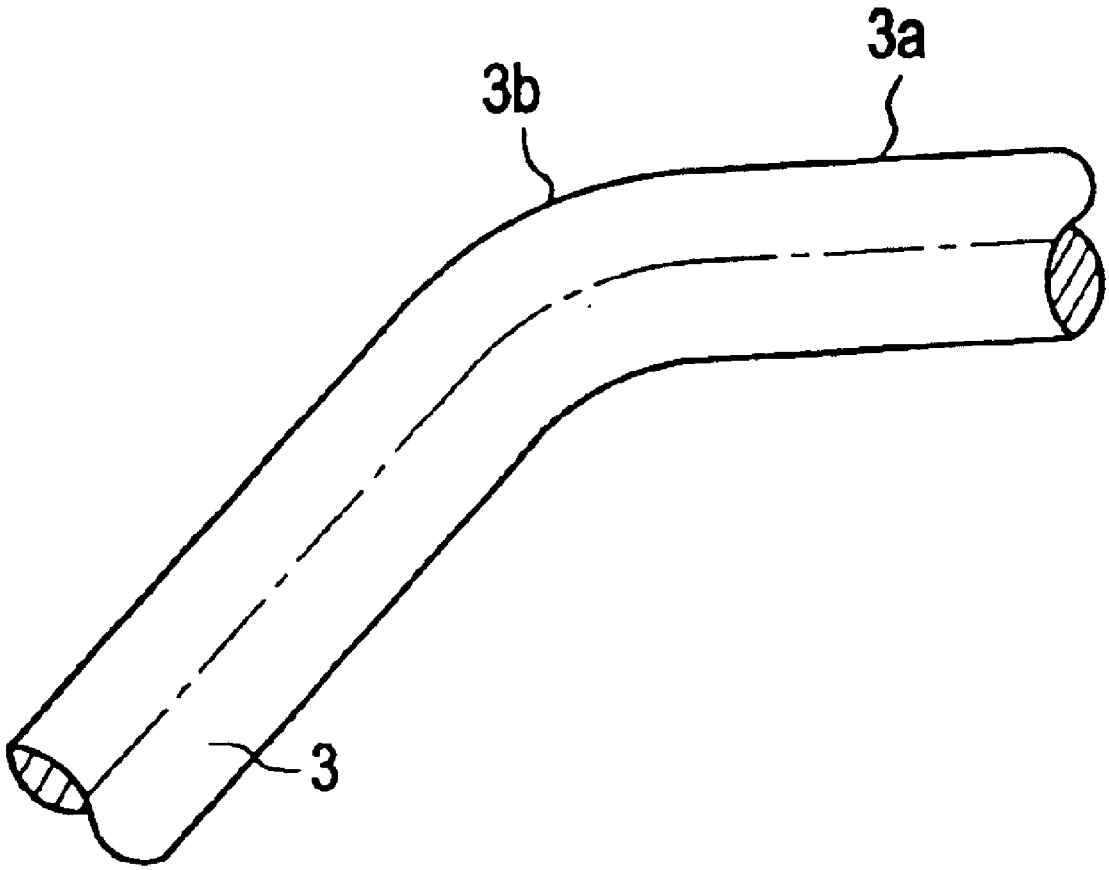
FIG. 5 illustrates an enlarged view of the brace part having a curved/buckled portion.

FIGS. 4*a* and 4*b* show views of a three-boom lattice girder frame in which a bracing element 11, consisting of the two truss braces 10 and two cross-ties 4, is arranged between the lower and upper boom members 2, 8.

The truss braces 10 in combination with the cross tie 4, allow the bending tolerances of the thicker upper boom member 8 to be compensated by placing the upper boom member 8 between a straight bridge piece 3*a* of the truss braces 10. As illustrated in FIGS. 3*a*–3*c*, the straight bridge piece 3*a* is connected to the upper boom member 8 at welded connection 9.

Three or four (not shown) boom members 2, 8 arranged in parallel relative to each other and forming a triangle (when viewed in cross-section), are spatially connected to each other, while each of the truss braces 3 is provided with straight brace parts 3 spaced in V-shape relative to each other, which are connected to each other at one end via the straight bridge 3*a*. The truss braces 10 are arranged in a symmetrical plane extending laterally from the upper boom member 8 toward the axis of the lower boom member 2, wherein the lower boom members 2 are connected to each other by the cross ties 4 extending at right angles relative to the lower boom members 2.

The advantages of the invention may be summarized as follows. The immersion of the upper boom member 8 between the truss braces 10 at the straight bridge pieces 3*a* allow several options. On the one hand, the tolerances resulting in the area of the bending radii of the thick upper boom member 8 can be compensated by a difference in position between the boom member and truss braces (see FIG. 3*c*). On the other hand, the overall lattice girder heights can be modified by X+(a) or X−(a), respectively, by varying the position of the upper boom member 8 and by thus changing the resistance moments while maintaining the geometry of the truss braces 10.

Both possibilities substantially contribute to making production more cost-effective. The straight brace part 3 abutting the lower boom member 2 without bending and the cross tie 4 arranged directly adjacent to it allow to use greater brace cross-sections and a pre-fabrication of the bracing elements 11 in an easy way. The arranged weld 1, 7 including both the abutting straight brace part 3 as well as the cross-tie 4 is sufficiently long to absorb the tensile and compressive forces present at that point. By avoiding bending and by the lateral arrangement of welds 1, 7, the economic efficiency of production can be improved still further.

A fixture is used to weld the truss braces 10 in the desired inclined position to the cross ties 4 at the weld connections 5 so that an inelastic bracing element 11 is produced. Such bracing elements 11 are arranged in series between the boom members 2, 8 and welded to the boom members in a fixture.

The lattice arches for tunnel construction are produced in segments which are combined inside the tunnel to form an arch by connections at the segment ends.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A lattice girder supporting frame for tunnel lining comprising:

an upper boom member and two lower boom members arranged in parallel relative to each other and forming a triangle;

truss braces spatially connecting said upper boom member and said lower boom members to each other, wherein each of said truss braces has a general V-shape comprising two straight brace parts each having a first and second end, said two straight brace parts connected to each other at the first end via a straight bridge piece, wherein said truss braces are arranged in a symmetrical plane extending laterally from said upper boom member to an axis of each of said lower boom members;

cross ties extending at right angles relative to said lower boom members, for connecting said lower boom members to each other, wherein the second end of each of said two straight brace parts, which are not connected by said straight bridge piece, terminate at said lower boom members, said second ends terminating without a bend and being welded to said lower boom members.

2. A lattice girder supporting frame according to claim 1, wherein said truss braces abut said lower boom members at an acute angle, and said cross-ties are provided inside the acute angle so as to be welded to said lower boom members and said straight brace parts of said truss brace.

3. A lattice girder supporting frame according to claim 1, wherein ends of said cross tie are disposed between said truss braces and said lower boom members, so as to be welded between said truss braces and said lower boom members.

4. A lattice girder supporting frame according to claim 1, wherein each of said straight brace parts are connected to each other at said first end through a buckled part, with said straight bridge piece located in between said buckled parts, and extending in parallel to said upper and lower boom members.

5. A lattice girder supporting frame according to claim 1, wherein said upper boom member is arranged between said straight bridge pieces of said truss braces and welded thereto.

6. A lattice girder supporting frame according to claim 1, wherein said upper boom member is capable of being positioned at different heights relative to said straight bridge piece of said truss, wherein the height of said straight bridge piece of said truss is X±a, wherein a is <a radius of the upper boom member, and X is the height of the upper boom member.

7. A bracing element for a lattice girder supporting frame having upper and lower boom members, comprising:

two brace parts angled relative to each other, wherein one end of each of said brace parts has a curved part and the other end of each of said brace parts is straight, the other end of each of said brace parts terminating at, and adapted to be connected to, the lower boom members without a bend on the other end;

a straight bridge piece connecting said brace parts to each other at said curved parts so as to form a truss brace, wherein said straight bridge piece extends parallel to the upper and lower boom members;

wherein two truss braces are connected to each other via cross-ties so as to form the bracing element, wherein said cross-ties are fixedly secured by a weld to said truss braces, and wherein said cross-ties are adaptable to contact the lower boom members.

8. A truss brace of a bracing element for a lattice supporting frame, comprising:

two brace parts, each of said two brace parts including a first end which is curved and a second end which is straight; and a straight bridge piece connecting said first ends of said two brace parts so that said two brace parts are disposed at an angle with respect to each other, wherein said second ends terminate at a lower boom of the lattice supporting frame.

* * * * *